US011884988B2

(12) United States Patent
Nakamura et al.

(10) Patent No.: US 11,884,988 B2
(45) Date of Patent: Jan. 30, 2024

(54) BASE SHEET FOR GRAIN-ORIENTED ELECTRICAL STEEL SHEET, GRAIN-ORIENTED SILICON STEEL SHEET WHICH IS USED AS MATERIAL OF BASE SHEET FOR GRAIN-ORIENTED ELECTRICAL STEEL SHEET, METHOD OF MANUFACTURING BASE SHEET FOR GRAIN-ORIENTED ELECTRICAL STEEL SHEET, AND METHOD OF MANUFACTURING GRAIN-ORIENTED ELECTRICAL STEEL SHEET

(71) Applicant: NIPPON STEEL CORPORATION, Tokyo (JP)

(72) Inventors: Shuichi Nakamura, Tokyo (JP); Seiki Takebayashi, Tokyo (JP); Yoshiyuki Ushigami, Tokyo (JP); Shinsuke Takatani, Tokyo (JP); Hiroyasu Fujii, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 362 days.

(21) Appl. No.: 17/256,891

(22) PCT Filed: Jul. 13, 2018

(86) PCT No.: PCT/JP2018/026625
§ 371 (c)(1),
(2) Date: Dec. 29, 2020

(87) PCT Pub. No.: WO2020/012667
PCT Pub. Date: Jan. 16, 2020

(65) Prior Publication Data
US 2021/0317542 A1 Oct. 14, 2021

(51) Int. Cl.
*C21D 9/46* (2006.01)
*C23C 8/02* (2006.01)
(Continued)

(52) U.S. Cl.
CPC ..... *C21D 9/46* (2013.01); *C21D 8/1222* (2013.01); *C21D 8/1233* (2013.01);
(Continued)

(58) Field of Classification Search
CPC ..... C21D 2201/05; C21D 3/02; C21D 3/08; C21D 6/008; C21D 8/0247; C21D 8/12;
(Continued)

(56) References Cited

U.S. PATENT DOCUMENTS 5,961,744 A * 10/1999 Yamazaki ..... H01F 1/14783 148/113
2003/0180553 A1 9/2003 Shigesato et al.

FOREIGN PATENT DOCUMENTS

EP 0 565 029 A1 10/1993
JP 2-243754 A 9/1990
(Continued)

*Primary Examiner* — Jenny R Wu
(74) *Attorney, Agent, or Firm* — Birch, Stewart, Kolasch & Birch, LLP

(57) ABSTRACT

In a base sheet for a grain-oriented electrical steel sheet of the present invention, an amount of surface oxygen x per one surface of the base sheet and a value y of a peak ($\Delta R/R_0$ @1250 $cm^{-1}$) of $SiO_2$ on the surface of the base sheet obtained by infrared reflection spectroscopy satisfy $y \geq 1500x^{2.5}$ and $y \geq 0.24$. A method of manufacturing the base sheet for a grain-oriented electrical steel sheet of the present invention includes: adjusting the amount of surface oxygen per one surface of a final-annealed grain-oriented silicon steel sheet to more than 0.01 $g/m^2$ and 0.05 $g/m^2$ or less, or more than 0.05 $g/m^2$ and 0.10 $g/m^2$ or less; and performing thermal oxidation annealing in an atmosphere in which an
(Continued)

oxidation potential represented by a ratio $P_{H2O}/P_{H2}$ of water vapor pressure to hydrogen pressure is 0.0081 or less in a case where the amount of surface oxygen is more than 0.01 $g/m^2$ and 0.05 $g/m^2$ or less, or in an atmosphere in which the oxidation potential is 0.005 or less in a case where the amount of surface oxygen is more than 0.05 $g/m^2$ and 0.10 $g/m^2$ or less, at a soaking temperature of 1000° C. or lower to form an externally oxidized layer on a surface of the grain-oriented silicon steel sheet.

18 Claims, 3 Drawing Sheets

(51) Int. Cl.

| | |
|---|---|
| ***C21D 8/12*** | (2006.01) |
| ***C23C 8/18*** | (2006.01) |
| ***C22C 38/02*** | (2006.01) |
| ***C22C 38/00*** | (2006.01) |

(52) U.S. Cl.
CPC ..... *C21D 8/1288* (2013.01); *C22C 38/004* (2013.01); *C22C 38/02* (2013.01); *C23C 8/02* (2013.01); *C23C 8/18* (2013.01); *C21D 2201/05* (2013.01)

(58) Field of Classification Search
CPC .. C21D 8/1222; C21D 8/1233; C21D 8/1255; C21D 8/1283; C21D 8/1288; C21D 9/46; C22C 38/004; C22C 38/02; C23C 22/33; C23C 8/02; C23C 8/18; C23C 8/80; H01F 1/14775; H01F 1/16
See application file for complete search history.

(56) References Cited

FOREIGN PATENT DOCUMENTS

| | | | | | |
|---|---|---|---|---|---|
| JP | 6-184762 | A | | 7/1994 | |
| JP | 06184762 | A | * | 7/1994 | ..... C21D 8/1288 |
| JP | 8-269573 | A | | 10/1996 | |
| JP | 9-78252 | A | | 3/1997 | |
| JP | 0978252 | A | * | 3/1997 | |
| JP | 2002-332523 | A | | 11/2002 | |
| JP | 2004-315880 | A | | 11/2004 | |
| JP | 2004-342679 | A | | 12/2004 | |
| JP | 2005-146315 | A | | 6/2005 | |
| JP | 2005-264236 | A | | 9/2005 | |
| JP | 3930696 | B2 | | 6/2007 | |
| JP | 4044739 | B2 | | 2/2008 | |
| JP | 4288022 | B2 | | 7/2009 | |
| JP | 2010-196081 | A | | 9/2010 | |

* cited by examiner

BASE SHEET FOR GRAIN-ORIENTED ELECTRICAL STEEL SHEET, GRAIN-ORIENTED SILICON STEEL SHEET WHICH IS USED AS MATERIAL OF BASE SHEET FOR GRAIN-ORIENTED ELECTRICAL STEEL SHEET, METHOD OF MANUFACTURING BASE SHEET FOR GRAIN-ORIENTED ELECTRICAL STEEL SHEET, AND METHOD OF MANUFACTURING GRAIN-ORIENTED ELECTRICAL STEEL SHEET

TECHNICAL FIELD OF THE INVENTION

The present invention relates to a base sheet for a grain-oriented electrical steel sheet, a grain-oriented silicon steel sheet which is used as a material of the base sheet for a grain-oriented electrical steel sheet, a method of manufacturing the base sheet for a grain-oriented electrical steel sheet, and a method of manufacturing a grain-oriented electrical steel sheet.

RELATED ART

It is known that the surface of a steel sheet is smoothed (mirror-finished) as a measure for reducing an iron loss value, which is a main characteristic required for grain-oriented electrical steel sheets used for iron core materials of transformers or the like. However, securing adhesion between the mirror-finished surface of the steel sheet and a tension coating (insulation coating) for an insulating property that is indispensable as an iron core material and for applying tension is a problem in commercialization. To solve the problem, various techniques have been proposed.

For example, as a technique for securing the adhesion of a tension coating, Patent Document 1 discloses a technique for forming an externally oxidized layer in which voids occupy 30% or less in terms of cross-sectional area ratio, in a range of 40 nm or more and 500 nm or less at the interface between a tension coating and a steel sheet. In this technique, thermal oxidation annealing is performed at 1000° C. or higher.

Patent Document 2 discloses a technique for forming an externally oxidized layer in which an oxide composed of one or two or more elements of iron, aluminum, titanium, manganese, and chromium occupies 50% or less in terms of cross-sectional area, in a range of 2 nm or more and 500 nm or less at the interface between a tension coating and a steel sheet.

However, in a case of manufacturing a product by the technique of Patent Document 1 or 2, it is practically necessary to form an externally oxidized layer by annealing at 1000° C. or higher. During such annealing at 1000° C. or higher, in a case where tension sheet passing is not appropriately performed, strain is introduced into the steel sheet during the sheet passing, and there is a problem that the iron loss characteristics deteriorate.

Patent Document 3 discloses that when an externally oxidized $SiO_2$ film of 100 mg/m$^2$ or less per one surface is formed on the surface of a steel sheet in thermal oxidation annealing at 850° C., interface roughening that occurs between the steel sheet and the externally oxidized $SiO_2$ film can be prevented, and good iron loss characteristics are obtained. However, in this technique, coating adhesion after baking a tension coating is not always good.

Patent Document 4 discloses that by introducing minute strain by wiping the surface of a steel sheet with a brush with abrasive grains, or by forming minute unevenness by pickling prior to forming an externally oxidized $SiO_2$ film, the growth of externally oxidized $SiO_2$ from the minute strain or minute unevenness as the origin is promoted, and a granular oxide is formed at the same time, thereby improving coating adhesion. However, in this technique, the adhesion of the coating is not good when a heat treatment temperature is lower than 1000° C.

Patent Document 5 proposes a technique for forming an intermediate layer such as TiN on the surface of a mirror-finished grain-oriented electrical steel sheet by PVD, CVD, or the like to secure the adhesion of a tension coating. However, this technology is expensive and has not been industrialized.

Patent Document 6 proposes a technique for forming an externally oxidized $SiO_2$ film by performing thermal oxidation on a mirror-finished grain-oriented electrical steel sheet with a relatively low oxidation potential. However, this technique has a problem that the adhesion of a tension coating is not stable.

Patent Document 7 proposes a technique in which an oxide or hydroxide is formed on the surface of a steel sheet, a liquid composed of colloidal silica, silicate, or the like is then applied and dried, and thereafter a tension coating forming heat treatment is performed to form a coating layer containing Si between the steel sheet and a tension coating and simultaneously form a $SiO_2$ film at the interface between the coating layer and a base steel sheet. However, the $SiO_2$ film formed by this technique has a problem that the adhesion after forming the tension coating is not stable.

Patent Document 8 discloses an example in which an aluminum oxide film is formed on the surface of a steel sheet, a heat treatment is performed thereon for strain relaxation, and thereafter a tension coating forming heat treatment is performed. In this technique, there is no mention of the formation of an externally oxidized $SiO_2$ film in the heat treatment for strain relaxation, but even if a $SiO_2$ film is formed after the heat treatment, the kind of oxide, the amount of the oxide, and the atmosphere of the heat treatment are not appropriate. Therefore, the $SiO_2$ film as in the present invention is not formed, and the adhesion after forming a tension coating is not sufficiently improved.

Patent Document 9 proposes a technique of performing a tension coating forming heat treatment after a reducing heat treatment of a steel sheet in which an oxide remains on the surface of the steel sheet. In this technique, there is no mention of the formation of an externally oxidized $SiO_2$ film, but even if a $SiO_2$ film is formed after the reducing heat treatment, the amount of oxide before the heat treatment and the atmosphere of the heat treatment are not appropriate. Therefore, a $SiO_2$ film having an appropriate oxygen balance as in the present invention is not formed, and the adhesion after forming a tension coating is not sufficiently improved.

Patent Document 10 proposes a technique of performing a heat treatment on a steel sheet in which oxides of Al, Si, Ti, Cr, and Y are formed on the surface of the steel sheet to form a $SiO_2$ film, and thereafter performing a tension coating forming heat treatment. However, since the kind of oxide, the amount of the oxide, and the atmosphere of the heat treatment are not appropriate, the $SiO_2$ film itself to be formed does not deviate from the scope of other techniques in the related art, and the adhesion after forming the tension coating is not sufficiently improved.

PRIOR ART DOCUMENT

Patent Document

[Patent Document 1] Japanese Patent No. 4288022
[Patent Document 2] Japanese Patent No. 4044739

[Patent Document 3] Japanese Unexamined Patent Application, First Publication No. H09-078252

[Patent Document 4] Japanese Patent No. 3930696

[Patent Document 5] Japanese Unexamined Patent Application, First Publication No. 2005-264236

[Patent Document 6] Japanese Unexamined Patent Application, First Publication No. H06-184762

[Patent Document 7] Japanese Unexamined Patent Application, First Publication No. 2004-342679

[Patent Document 8] Japanese Unexamined Patent Application, First Publication No. H02-243754

[Patent Document 9] Japanese Unexamined Patent Application, First Publication No. H08-269573

[Patent Document 10] Japanese Unexamined Patent Application, First Publication No. 2004-315880

DISCLOSURE OF THE INVENTION

Problems to be Solved by the Invention

The present inventors considered the current state of the related art of grain-oriented electrical steel sheets having a tension coating, and thought that it is necessary to control surface properties of a steel sheet (a base sheet for a grain-oriented electrical steel sheet) before forming a tension coating in order to apply high coating adhesion to the tension coating of the grain-oriented electrical steel sheet without introducing a large strain into the grain-oriented electrical steel sheet. An object of the present invention is to provide a base sheet for a grain-oriented electrical steel sheet capable of stably securing the adhesion of a tension coating even by thermal oxidation annealing in which a soaking temperature at which strain is less likely to be introduced into an electrical steel sheet is 1000° C. or lower prior to the formation of the tension coating. Another object of the present invention is to provide a method of manufacturing the base sheet for a grain-oriented electrical steel sheet, and a grain-oriented silicon steel sheet which is used as a material of the base sheet for a grain-oriented electrical steel sheet. Still another object of the present invention is to provide a method of manufacturing a grain-oriented electrical steel sheet capable of forming a tension coating having high adhesion without introducing a large strain into the steel sheet.

Means for Solving the Problem

In order to avoid deterioration of iron loss characteristics due to the occurrence of strain during thermal oxidation annealing, the present inventors intensively studied the formation of an externally oxidized layer on a base sheet for a grain-oriented electrical steel sheet (base sheet) by thermal oxidation annealing with a soaking temperature of 1000° C. or lower.

In the related art, an externally oxidized layer which is formed by thermal oxidation annealing at 1000° C. or lower in order to avoid strain during the thermal oxidation annealing basically has a small amount of oxygen. In a case where a base sheet having such an externally oxidized layer was formed by baking a tension coating in a normal atmosphere, an internally oxidized layer was formed on the base metal side, and sufficient adhesion of the tension coating could not be secured.

In addition, since the externally oxidized layer formed by the thermal oxidation annealing at 1000° C. or lower was relatively thin, the tension coating could not be stably maintained in the heat treatment for forming the tension coating, and there were cases where a portion of the tension coating was lost. That is, according to the base sheet obtained by the thermal oxidation annealing at 1000° C. or lower, it was difficult to stably obtain good adhesion of the tension coating.

As a result of intensive studies on a method for solving the above problems, the present inventors found that by controlling the surface properties (evaluated by IR measurement) of a base sheet for a grain-oriented electrical steel sheet, the generation of an internally oxidized layer on the base metal side is avoided even if the amount of oxygen in an externally oxidized layer is small, and sufficient adhesion of a tension coating can be secured.

In addition, it was found that by adjusting the amount of surface oxygen of a final-annealed grain-oriented silicon steel sheet (final-annealed steel sheet) before thermal oxidation annealing to a predetermined range, and then performing the thermal oxidation annealing at a soaking temperature of 1000° C. or lower in an atmosphere in which an oxidation potential $P_{H2O}/P_{H2}$ is within a predetermined range, the generation of an internally oxidized layer is avoided while avoiding the introduction of strain into the base sheet, and an externally oxidized layer primarily containing $SiO_2$ is formed, whereby a base sheet for a grain-oriented electrical steel sheet can be manufactured.

Furthermore, by applying a tension coating-forming coating agent onto the base sheet for a grain-oriented electrical steel sheet manufactured by the above manufacturing method and performing a tension coating forming heat treatment thereon in a baking atmosphere of in which an oxidation potential represented by the ratio $P_{H2O}/P_{H2}$ of water vapor pressure to hydrogen pressure is 0.001 to 0.20, a grain-oriented electrical steel sheet having good adhesion of an insulation coating can be manufactured.

The present invention has been made based on such findings, and the gist thereof is as follows.

[1] In a base sheet for a grain-oriented electrical steel sheet according to an aspect of the present invention, an amount of surface oxygen x per one surface of the base sheet and a value y of a peak ($\Delta R/R_0$ @1250 $cm^{-1}$) of $SiO_2$ on the surface of the base sheet obtained by infrared reflection spectroscopy satisfy $$y \geq 1500x^{2.5} \quad (1), \text{ and}$$

$$y \geq 0.24 \quad (2).$$

[2] The base sheet for a grain-oriented electrical steel sheet according to [1] may further satisfy $$y \leq 0.89 \quad (3).$$

[3] The base sheet for a grain-oriented electrical steel sheet according to [1] or [2] may further satisfy $$6440x^{2.5} \geq y \quad (4).$$

[4] A material steel sheet according to another aspect of the present invention is a material steel sheet of the base sheet for a grain-oriented electrical steel sheet according to any one of [1] to [3], in which an amount of surface oxygen per one surface of the grain-oriented silicon steel sheet is more than 0.01 $g/m^2$ and 0.1 $g/m^2$ or less.

[5] A method of manufacturing a base sheet for a grain-oriented electrical steel sheet according to another aspect of the present invention is a method of manufacturing the base sheet for a grain-oriented electrical steel sheet according to any one of [1] to [3], the method including: adjusting the amount of surface oxygen per one surface of a final-annealed grain-oriented silicon steel sheet to more than 0.01 g/m$^2$ and 0.05 g/m$^2$ or less, or more than 0.05 g/m$^2$ and 0.10 g/m$^2$ or less; and performing thermal oxidation annealing on the final-annealed grain-oriented silicon steel sheet in an atmosphere in which an oxidation potential represented by a ratio $P_{H2O}/P_{H2}$ of water vapor pressure to hydrogen pressure is 0.0081 or less in a case where the amount of surface oxygen is more than 0.01 g/m$^2$ and 0.05 g/m$^2$ or less, or in an atmosphere in which the oxidation potential is 0.005 or less in a case where the amount of surface oxygen is more than 0.05 g/m$^2$ and 0.10 g/m$^2$ or less, at a soaking temperature of 1000° C. or lower to form an externally oxidized layer on a surface of the grain-oriented silicon steel sheet.

[6] A method of manufacturing a grain-oriented electrical steel sheet according to another aspect of the present invention, includes: applying a tension coating-forming coating agent to the base sheet for a grain-oriented electrical steel sheet according to any one of [1] to [3]; and performing a tension coating forming heat treatment in a baking atmosphere in which an oxidation potential represented by a ratio $P_{H2O}/P_{H2}$ of water vapor pressure to hydrogen pressure is 0.001 to 0.20.

Effects of the Invention

According to the present invention, at a soaking temperature of 1000° C. or lower, on the surface of a base sheet for a grain-oriented electrical steel sheet, an externally oxidized layer primarily containing $SiO_2$, which can stably secure sufficient adhesion of a tension coating while avoiding the introduction of strain into the base sheet, can be formed. As a result, a grain-oriented electrical steel sheet having stable and good adhesion of the tension coating can be industrially manufactured by an ordinary annealing line.

EMBODIMENTS OF THE INVENTION

Figure 1:
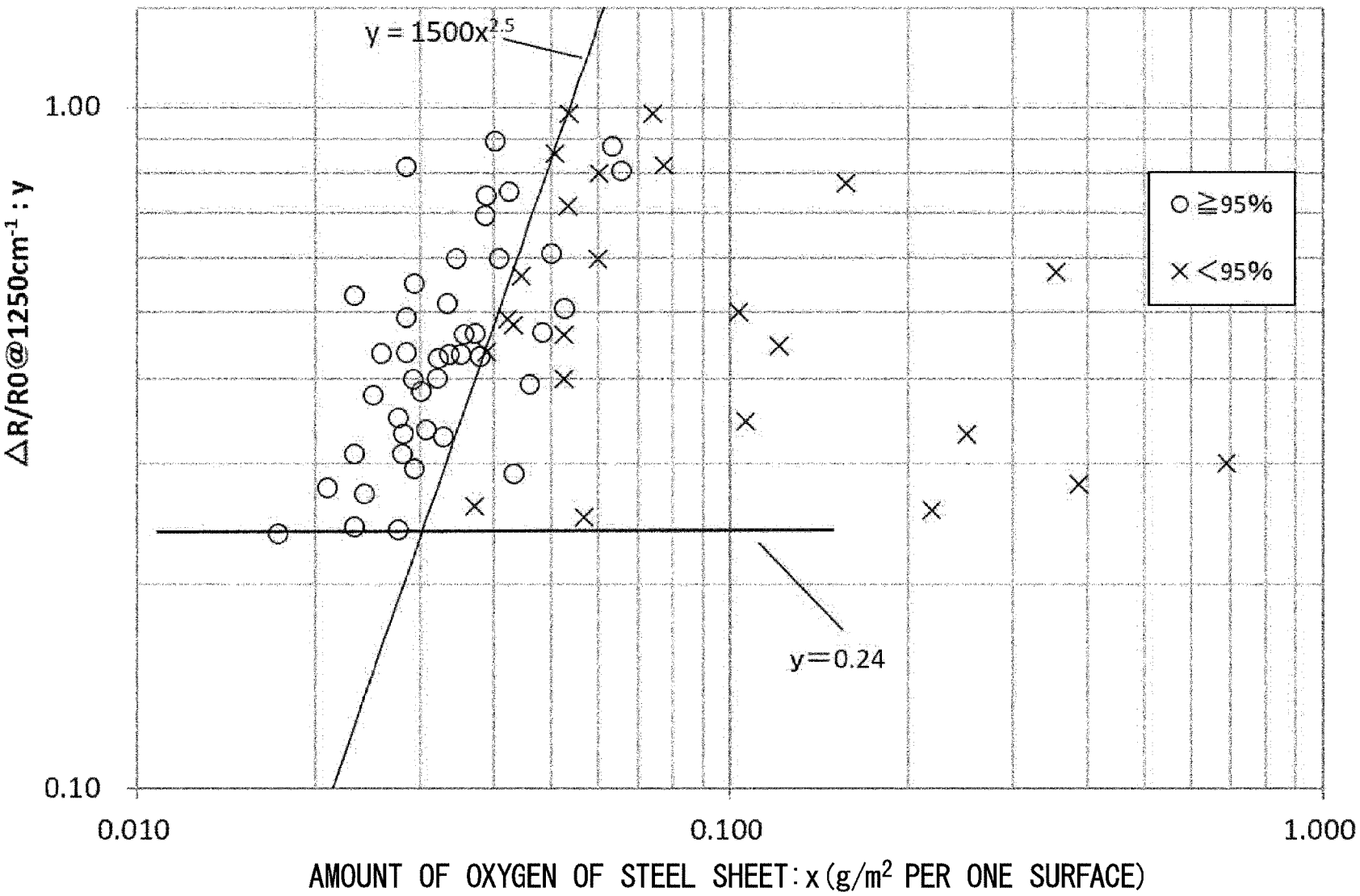
FIG. 1 is a diagram showing a relationship between, in a base sheet for a grain-oriented electrical steel sheet according to an aspect of the present invention, the amount of oxygen (g/m$^2$) per one surface and a peak (IR spectral intensity: $\Delta R/R_0$ @1250 cm$^{-1}$) of $SiO_2$ on the surface obtained by infrared reflection spectroscopy, and the adhesion of a tension coating of a grain-oriented electrical steel sheet obtained using the base sheet.

Hereinafter, a base sheet for a grain-oriented electrical steel sheet according to the present embodiment (hereinafter, sometimes referred to as "the base sheet according to the present embodiment") and the like will be described. Here, the base sheet according to the present embodiment will be described as a base sheet for a grain-oriented electrical steel sheet before forming a tension coating, in which the base sheet has no glass film. However, the technical scope of the base sheet according to the present embodiment extends to a grain-oriented electrical steel sheet after forming a tension coating.

In the base sheet according to the present embodiment, the amount of surface oxygen x per one surface of the base sheet and a value y of a peak ($\Delta R/R_0$ @1250 cm$^{-1}$) of $SiO_2$ on the surface of the base sheet obtained by infrared reflection spectroscopy satisfy $$y \geq 1500x^{2.5} \quad (1), \text{ and}$$

$$y \geq 0.24 \quad (2).$$

In addition, the base sheet according to the present embodiment may further satisfy the following mathematical formulas, as necessary.

$$y \leq 0.89 \quad (3)$$

$$6440x^{2.5} \geq y \quad (4)$$

A method of manufacturing the base sheet for a grain-oriented electrical steel sheet according to the present embodiment (hereinafter, sometimes referred to as a "base sheet manufacturing method according to the present embodiment") is a manufacturing method of manufacturing the base sheet according to the present embodiment, including: adjusting an amount of surface oxygen per one surface of a final-annealed grain-oriented silicon steel sheet to more than 0.01 g/m$^2$ and 0.05 g/m$^2$ or less, or more than 0.05 g/m$^2$ and 0.10 g/m$^2$ or less; and performing thermal oxidation annealing on the final-annealed grain-oriented silicon steel sheet at a soaking temperature of 1000° C. or lower in an atmosphere in which an oxidation potential represented by a ratio $P_{H2O}/P_{H2}$ of water vapor pressure to hydrogen pressure is 0.0081 or less in a case where the amount of surface oxygen is more than 0.01 g/m$^2$ and 0.05 g/m$^2$ or less, or in an atmosphere in which the oxidation potential is 0.005 or less (less than 0.0055) in a case where the amount of surface oxygen is more than 0.05 g/m$^2$ and 0.10 g/m$^2$ or less to form an externally oxidized layer on a surface of the grain-oriented silicon steel sheet.

The grain-oriented silicon steel sheet according to the present embodiment is a grain-oriented silicon steel sheet which is used as a material of the base sheet according to the present embodiment, and is the above-mentioned final-annealed grain-oriented silicon steel sheet, in which the amount of surface oxygen per one surface is more than 0.01 g/m$^2$ and 0.1 g/m$^2$ or less.

A method of manufacturing a grain-oriented electrical steel sheet according to the present embodiment includes: applying a tension coating-forming coating agent to the base sheet according to the present embodiment; and performing a tension coating forming heat treatment in a baking atmosphere in which an oxidation potential represented by a ratio $P_{H2O}/P_{H2}$ of water vapor pressure to hydrogen pressure is 0.001 to 0.20.

Hereinafter, the base sheet according to the present embodiment, the method of manufacturing the base sheet according to the present embodiment, and the method of manufacturing a grain-oriented electrical steel sheet according to the present embodiment will be described.

Figure 2:
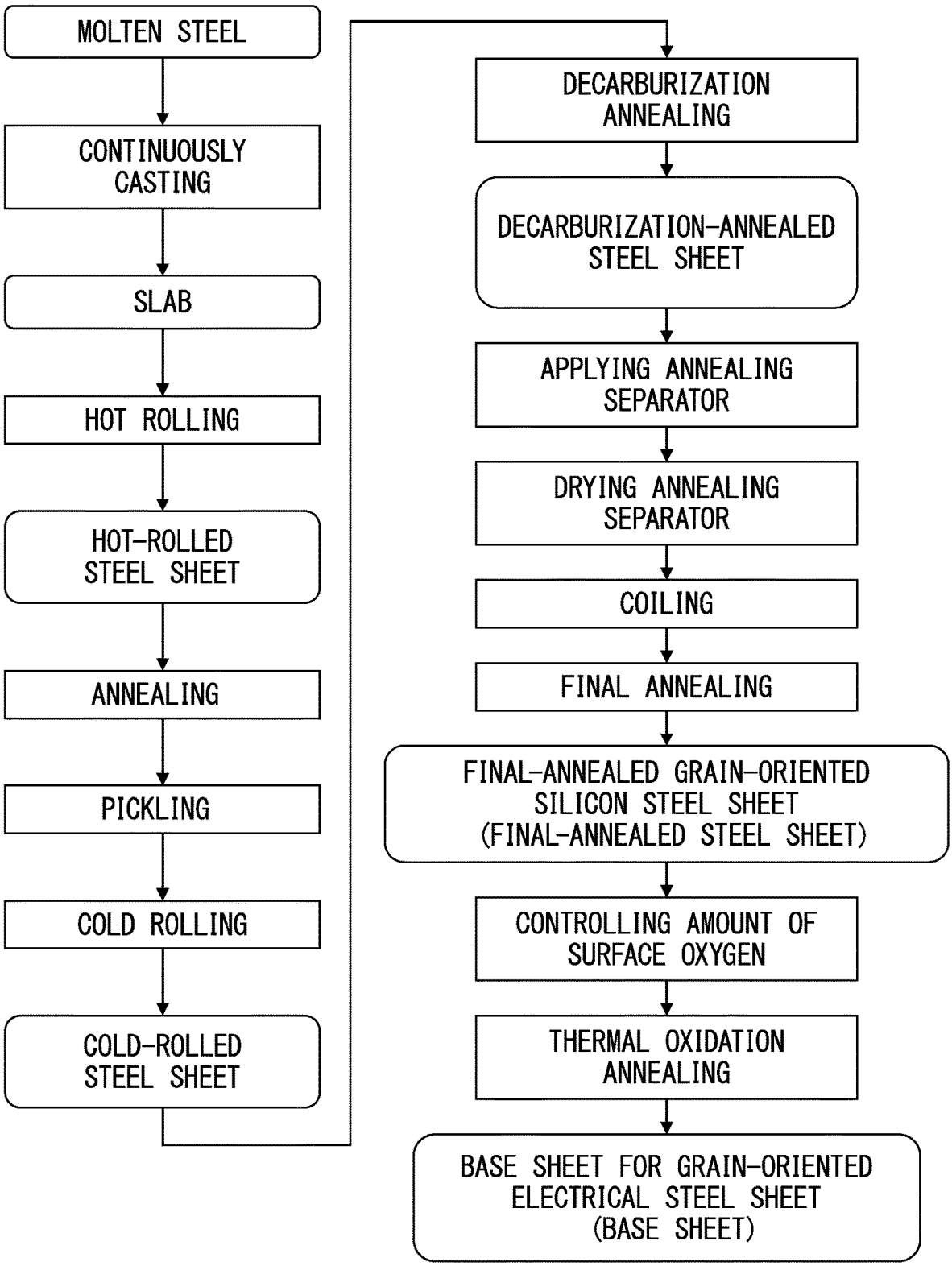
FIG. 2 is a flowchart showing a method of manufacturing the base sheet for a grain-oriented electrical steel sheet (base sheet) according to an aspect of the present invention.
Figure 3:
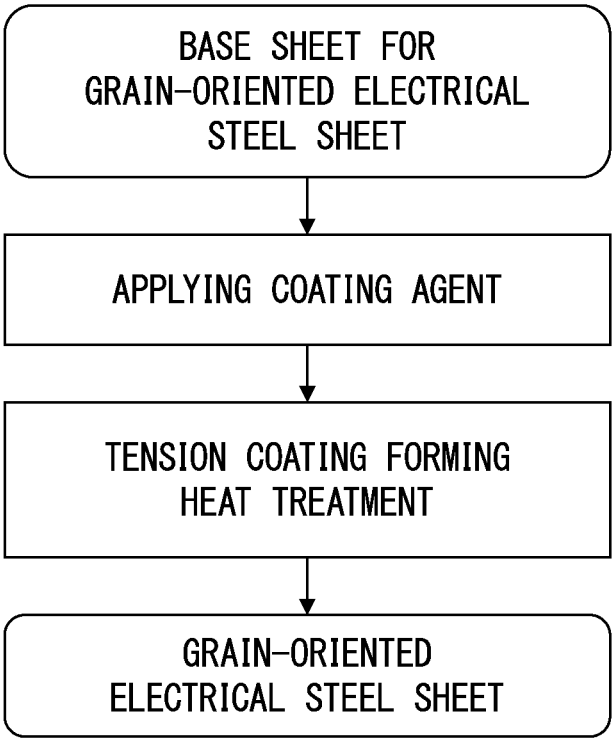
FIG. 3 is a flowchart showing a method of manufacturing a grain-oriented electrical steel sheet according to an aspect of the present invention.

First, the final-annealed grain-oriented silicon steel sheet (final-annealed steel sheet) having no glass film on the surface, which is used as a base steel sheet of the base sheet according to the present embodiment, will be described. As shown in FIG. 2, the base sheet for a grain-oriented electrical steel sheet according to the present embodiment is obtained by first manufacturing a final-annealed grain-oriented silicon steel sheet by performing hot rolling, cold rolling, decarburization annealing, application and drying of an annealing separator, coiling, and final annealing on a steel piece, and performing control of the amount of surface oxygen and thermal oxidation annealing on the final-annealed grain-oriented silicon steel sheet. That is, the final-annealed grain-oriented silicon steel sheet is an intermediate material of the base sheet for a grain-oriented electrical steel sheet.

The base sheet according to the present embodiment has surface properties (the amount of oxygen x per one surface of the base sheet and a value y of a peak ($\Delta R/R_0$ @1250 $cm^{-1}$) of $SiO_2$ on the surface of the base sheet obtained by infrared reflection spectroscopy satisfy Formula (1) and Formula (2), and further satisfy Formula (3) and Formula (4) as necessary). Since the surface properties of the base sheet are substantially unaffected by the chemical composition of the final-annealed grain-oriented silicon steel sheet used as the base steel sheet other than Si, the chemical composition of the final-annealed grain-oriented silicon steel sheet is not particularly limited to the chemical composition other than Si. Hereinafter, a preferred chemical composition will be described as an example.

The chemical composition of the final-annealed steel sheet is preferably a chemical composition including, by mass %, Si: 0.8% to 7.0% as a basic element, one or two of C: 0% to 0.085%, acid-soluble Al: 0% to 0.065%, N: 0% to 0.012%, Mn: 0% to 1.0%, Cr: 0% to 0.3%, Cu: 0% to 0.4%, P: 0% to 0.5%, Sn: 0% to 0.3%, Sb: 0% to 0.3%, Ni: 0% to 1.0%, S: 0% to 0.015%, and Se: 0% to 0.015% as optional elements, and a remainder of Fe and impurities.

The chemical component is a preferable chemical component for forming a Goss texture in which crystal orientations are integrated in a {110}<001> orientation. The optional elements may be appropriately contained depending on the purpose, so that the lower limit thereof may be 0%. Moreover, the optional elements may be contained as impurities. Impurities mean elements that are incorporated into the final-annealed steel sheet from steel raw materials (ore, scrap, and the like) and/or from manufacturing environments.

In the manufacturing of a grain-oriented electrical steel sheet, usually, at the time of secondary recrystallization, purification annealing for discharging inhibitor-forming elements to the outside of the steel sheet is simultaneously performed. In particular, the amounts of N and S are each reduced to 50 ppm or less. The amounts of N and S are each reduced preferably to 9 ppm or less, and more preferably 6 ppm or less. Purification annealing may be performed sufficiently to reduce the amounts of N and S to an extent that cannot be detected by ordinary analysis (1 ppm or less).

The chemical composition of the final-annealed steel sheet may be analyzed by a general analysis method. For example, the chemical composition of the final-annealed steel sheet may be analyzed using Inductively Coupled Plasma-Atomic Emission Spectrometry (ICP-AES). For example, a 35 mm square test piece can be collected from the central position of the final-annealed steel sheet and analyzed based on a calibration curve created in advance using ICPS-8100 or the like (measuring device) manufactured by Shimadzu Corporation. Here, C and S may be analyzed by using the combustion-infrared absorption method, and N may be analyzed by using the inert gas fusion-thermal conductivity method.

In a general method of manufacturing a base sheet for a grain-oriented electrical steel sheet, a glass film is formed on the surface of the final-annealed steel sheet. The glass film is composed of a composite oxide such as forsterite ($Mg_2SiO_4$), spinel ($MgAl_2O_4$), or cordierite ($Mg_2Al_4Si_5O_{16}$). The glass film is a film which is interposed between the steel sheet and a tension coating, and is formed to secure adhesion of oxide films (the glass film and the tension coating) to the steel sheet by the so-called anchor effect by forming complex unevenness at the interface between the steel sheet and the tension coating. The glass film is formed in one final annealing process of a manufacturing process of the grain-oriented electrical steel sheet.

On the other hand, in the method of manufacturing the base sheet according to the present embodiment, a steel sheet that has been final-annealed under the condition that a glass film is not formed, is used as a base sheet material (that is, a final-annealed steel sheet). Alternatively, the base sheet material may be a steel sheet obtained by removing, from a steel sheet in which a glass film is formed, the glass film by pickling or the like, and thereafter performing mirror finishing thereon by chemical polishing or the like.

Next, a method of manufacturing the base sheet for a grain-oriented electrical steel sheet (base sheet manufacturing method) according to the present embodiment will be described. In the following description, general conditions will be exemplified as conditions that are not limiting requirements in the base sheet manufacturing method according to the present embodiment. However, in the manufacturing method according to the present embodiment, the conditions that are not the limiting requirements are not limited to general requirements, which will be described later. Even if the known conditions are applied for a known purpose to the conditions that are not the limiting requirements, the manufacturing method according to the present embodiment exhibits the required effects.

First, molten steel is continuously cast into a slab. The chemical composition of this slab is not particularly limited, but contains, for example, by mass %, Si: 0.8% to 7.0%, C: more than 0% to 0.085%, acid-soluble Al: 0% to 0.065%, N: 0% to 0.012%, Mn: 0% to 1.0%, Cr: 0% to 0.3%, Cu: 0% to 0.4%, P: 0% to 0.5%, Sn: 0% to 0.3%, Sb: 0% to 0.3%, Ni: 0% to 1.0%, S: 0% to 0.015%, Se: 0% to 0.015%, and a remainder: Fe and impurities.

The slab is heated to a predetermined temperature (for example, 1050° C. to 1400° C.) and subjected to hot rolling. By this hot rolling, the slab is made into a hot-rolled steel sheet having a sheet thickness of, for example, 1.8 to 3.5 mm Subsequently, the hot-rolled steel sheet is subjected to an annealing treatment under predetermined heat treatment conditions (for example, at 750° C. to 1200° C. for 30 seconds to 10 minutes). The hot-rolled steel sheet after the annealing is subjected to a pickling treatment and then subjected to cold rolling. By this cold rolling, the hot-rolled steel sheet is made into a cold-rolled steel sheet having a sheet thickness of, for example, 0.15 to 0.35 mm.

Next, the cold-rolled steel sheet is subjected to a decarburization annealing treatment under predetermined heat treatment conditions (for example, at 700° C. to 900° C. for 1 to 3 minutes). By this decarburization annealing, C of the cold-rolled steel sheet is reduced to a predetermined amount or less, and a primary recrystallization structure is formed. Furthermore, an oxide layer primarily containing silica ($SiO_2$) is formed on the surface of the cold-rolled steel sheet after the decarburization annealing (hereinafter, referred to as decarburization-annealed steel sheet).

As necessary, a treatment for nitriding the decarburization-annealed steel sheet before applying an annealing separator may be included.

Subsequently, an annealing separator primarily containing alumina ($Al_2O_3$) is applied to the surface of the decarburization-annealed steel sheet (the surface of the oxide layer) and dried, and then the decarburization-annealed steel sheet is coiled. Then, the decarburization-annealed steel sheet is subjected to a final annealing treatment under predetermined heating conditions (for example, heated in the form of a coil at 1100° C. to 1300° C. for 20 to 24 hours). By this final annealing treatment, secondary recrystallization occurs in the decarburization-annealed steel sheet, and the steel sheet is purified. As a result, it is possible to obtain a final-annealed steel sheet in which the crystal orientation is controlled so that the magnetization easy axis of grains and a rolling direction coincide with each other.

Generally, the annealing separator primarily contains magnesia (MgO). In the final annealing of the decarburization-annealed steel sheet to which the annealing separator is applied, the oxide layer primarily containing silica on the surface of the decarburization-annealed steel sheet and the annealing separator primarily containing magnesia react with each other, so that a glass film containing a composite oxide such as forsterite ($Mg_2SiO_4$) is formed on the surface of the steel sheet.

However, in the base sheet manufacturing method according to the present embodiment, it is preferable not to form a glass film on the surface of the final-annealed steel sheet. For example, in a case where an annealing separator primarily containing alumina ($Al_2O_3$) is used as the annealing separator, the secondary recrystallization can be completed without forming a glass film on the surface of the steel sheet in the final annealing. However, a glass film may be formed once on the surface of the final-annealed steel sheet and thereafter removed.

In the manufacturing of a general grain-oriented electrical steel sheet, a tension coating is immediately formed on the final-annealed steel sheet. However, in the base sheet manufacturing method according to the present embodiment, the final-annealed steel sheet having no glass film is subjected to a control treatment of the amount of surface oxygen prior to the formation of the tension coating and is further subjected to thermal oxidation annealing. In the base sheet manufacturing method according to the present embodiment, a thin and dense externally oxidized film is formed by performing thermal oxidation annealing on a final-annealed steel sheet having an adjusted amount of surface oxygen.

Then, a tension coating is formed on the externally oxidized film while securing good coating adhesion, whereby a grain-oriented electrical steel sheet having excellent iron loss characteristics and having no glass film can be obtained. The method of manufacturing a grain-oriented electrical steel sheet according to the present embodiment will be described later.

The base sheet obtained by the above-described method includes the steel sheet and the externally oxidized film primarily containing $SiO_2$ disposed on the surface thereof. Next, the characteristics of the externally oxidized film formed by the base sheet manufacturing method according to the present embodiment will be described.

Patent Document 1, Patent Document 2, Patent Document 4, and the like describe those having a film thickness of 40 nm or more, which is suitable as an externally oxidized $SiO_2$ film. Patent Document 3 describes that setting the amount of $SiO_2$ per one surface of the base sheet to 100 mg/m$^2$ or less is effective in suppressing the deterioration of the iron loss characteristics. Here, when "an amount of $SiO_2$ of 100 mg/m$^2$ or less" is converted into a film thickness with the specific gravity of $SiO_2$ being 2, it is estimated that the film thickness of the externally oxidized $SiO_2$ film of the steel sheet disclosed in Patent Document 3 is "50 nm or less". In the externally oxidized $SiO_2$ film having such a film thickness, there is still a problem of the compatibility between suppressing deterioration of iron loss characteristics and securing adhesion of the tension coating. In a case where the amount of externally oxidized $SiO_2$ is small, it tends to be difficult to secure adhesion.

Furthermore, in a case where the amount of $SiO_2$ on the surface of the base sheet is 100 mg/m$^2$ or less per one surface of the base sheet, or in a case where the film thickness of $SiO_2$ on the surface of the base sheet is less than 40 nm, when the tension coating is baked in a nitrogen atmosphere in a normal baking atmosphere, there are cases where relatively good coating adhesion with an area fraction of remained coating of about 90% to 95%, which is measured by a method described later, can be obtained and cases where relatively good coating adhesion cannot be obtained. That is, in the above case, the adhesion of the tension coating is not stable. This tendency becomes remarkable especially in a case where the tension coating forming heat treatment is performed at a low oxidation potential.

Therefore, the present inventors consider that in a case of forming a thin externally oxidized $SiO_2$ film having a film thickness of less than 40 nm, it is necessary to more positively control the structure of a $SiO_2$ film than in the method in the related art, and intensively studied a control method thereof.

The present inventors found that although there is basically a correlation between the amount of externally oxidized $SiO_2$ per one surface of the base sheet and insulation coating adhesion, there are unusual cases where the coating adhesion is worsened while increasing the amount of externally oxidized $SiO_2$. In particular, the present inventors found that this tendency is remarkable in a case where a soaking time in thermal oxidation annealing for forming the externally oxidized $SiO_2$ is prolonged. In investigating the cause of this, the present inventors focused on the amount of surface oxygen x per one surface of the base sheet and a value y of a peak ($\Delta R/R_0$ @1250 cm$^{-1}$) of $SiO_2$ on the surface of the base sheet obtained by infrared reflection spectroscopy.

On the other hand, the present inventors discovered that when the soaking time in the thermal oxidation annealing is prolonged, there are cases where the amount of externally oxidized $SiO_2$ per one surface of the base sheet hardly increases and furthermore, the amount of oxygen per one surface of the base sheet slightly decreases, and in a case where this phenomenon occurs, good coating adhesion can be obtained. Based on this, the present inventors thought that there was some difference in the form of externally oxidized $SiO_2$ between a base sheet in which this phenomenon had occurred and a base sheet in which this phenomenon had not occur, and focused on an IR spectrum at 1250 cm$^{-1}$, which indicates the amount of $SiO_2$ present on the outermost surface.

Therefore, the present inventors changed the amount of oxygen x per one surface of the base sheet and the value y of a peak intensity $\Delta R/R_0$ of the IR spectrum at 1250 cm$^{-1}$, which indicates the amount of $SiO_2$ on the outermost surface, and evaluated the coating adhesion of a tension coating.

As a result, it was found that by controlling the amount of oxygen per one surface of the base sheet and the peak ($\Delta R/R_0$ @1250 cm$^{-1}$) of $SiO_2$ obtained by infrared reflection spectroscopy on the outermost surface of an externally oxidized $SiO_2$ film of the base sheet in a required relationship in thermal oxidation annealing, an externally oxidized film capable of securing good coating adhesion of the tension coating can be formed on the surface of the base sheet.

FIG. 1 shows a relationship between the amount of surface oxygen ($g/m^2$) per one surface of the base sheet, the peak (IR spectral intensity: $\Delta R/R_0$ @1250 $cm^{-1}$) of $SiO_2$ on the surface of the base sheet obtained by the infrared reflection spectroscopy, and the adhesion of the tension coating.

The relationship shown in FIG. 1 is the relationship between the amount of oxygen x ($g/m^2$) per one surface of the base sheet and the peak (IR spectral intensity: $\Delta R/R_0$ @1250 $cm^{-1}$) of $SiO_2$ on the surface of the base sheet obtained by infrared reflection spectroscopy in a thermal oxidation annealed steel sheet (the base sheet for a grain-oriented electrical steel sheet) obtained by performing thermal oxidation annealing on a final-annealed steel sheet containing 3.3 mass % of Si at a soaking temperature of lower than 1000° C. while changing an oxidation potential of an annealing soaking time of an annealing atmosphere, and the coating adhesion of a tension coating formed on the base sheet in a nitrogen hydrogen atmosphere with an oxidation potential $P_{H2O}/P_{H2}$ of 0.012. Here, the coating adhesion is the area fraction of remained coating on the surface of the steel sheet on the curvature center side, which is evaluated after winding and unwinding a sample of the grain-oriented electrical steel sheet around a cylinder having a diameter of 20 mm. In FIG. 1, samples plotted by the symbol "o" had an area fraction of remained coating of 95% or more, and samples plotted by the symbol "x" had an area fraction of remained coating of less than 95%.

From FIG. 1, it can be seen that in a case where a tension coating forming heat treatment is performed with a low oxidation potential, and in a case where the amount of oxygen x per one surface of the base sheet and the value y of the peak ($\Delta R/R_0$ @1250 $cm^{-1}$) of $SiO_2$ on the surface obtained by infrared reflection spectroscopy satisfies $y \geq 1500x^{2.5}$, good coating adhesion with an area fraction of remained coating of 95% or more is reliably obtained. In samples in which $y \geq 1500x^{2.5}$ was not satisfied, good coating adhesion could not be stably obtained. In some of the samples in which $y \geq 1500x^{2.5}$ was not satisfied, the area fraction of remained coating was 95% or more, which is considered to be accidental.

The peak of $SiO_2$ is calculated by a general method. For example, in an infrared absorption spectrum curve obtained in a range of 500 to 2000 $cm^{-1}$, when a background height at a position of a 1250 $cm^{-1}$ absorption peak indicating the presence of $SiO_2$ in the vicinity of the outermost surface is indicated as $R_0$, the difference in intensity between the peak top and the background is indicated as $\Delta R$, and $\Delta R/R_0$ is calculated. It is considered that this $\Delta R/R_0$ corresponds to the amount of $SiO_2$ present in the vicinity of the outermost surface and a bonded state of O. Since $\Delta R/R_0$ is the ratio of the intensity of the peak top to the background, an influence of measurement conditions on measured values of $\Delta R$ and $R_0$ is canceled out in $\Delta R/R_0$. This calculation may be performed for five points on the surface of the base sheet and the average value thereof may be used as $\Delta R/R_0$.

The amount of oxygen per one surface of the base sheet is obtained by analyzing the amount of oxygen at five points on the surface of the base sheet with EMGA-920 manufactured by HORIBA, calculating the amount of oxygen per one surface of the base sheet at the measurement points from the analysis values using the sheet thickness of the test material and the specific gravity of an Fe—Si alloy described in JIS corresponding to the amount of Si, and averaging these values.

It should be noted that the amount of oxygen per one surface of the base sheet obtained here contains not only the amount of oxygen due to oxides of Si but also the amount of oxygen due to oxides of Fe, Mn, Al, Cr, Ti, and the like (that is, oxides other than the externally oxidized $SiO_2$ film that is mainly controlled in the present embodiment). That is, the amount of oxygen obtained here has a value completely irrelevant to the thickness of the externally oxidized $SiO_2$ film. In a steel sheet in which oxides of Fe, Mn, Al, Cr, Ti, and the like are formed not only by external oxidation but also by internal oxidation, the amount of oxygen and the amount of externally oxidized $SiO_2$ film quantified separately have a great gap.

The present inventors presume the reason why good coating adhesion is obtained when x and y satisfy $y \geq 1500x^{2.5}$ as follows.

In a region where x is high, internal oxidation occurs and the adhesion of the insulation coating is significantly reduced. In a region where y is low, the amount of externally oxidized $SiO_2$ is small in a simple consideration. However, in a case where the amount of Si element and the amount of O element in this region are the same, oxygen in this region is not efficiently bonded to Si. As a result of these, as a situation in which a preferable form of externally oxidized $SiO_2$ is formed while suppressing internal oxidation, the left side of an upward sloping line (the left line with the formula "$y=1500^{2.5}$) in FIG. 1 showing the relationship between x and y, that is, an upper left region divided by $$y \geq 1500x^{2.5} \quad (1)$$

is preferable in terms of adhesion. In addition, $y \geq 1600x^{2.5}$, $y \geq 1800x^{2.5}$, $y \geq 2000x^{2.5}$, or $y \geq 2500x^{2.5}$ is preferable.

However, in the region where x is low, even though oxygen forms externally oxidized $SiO_2$, the amount of externally oxidized $SiO_2$ is small (the film thickness of the externally oxidized film is too small), and there are cases where the stability of the film deteriorates. In addition, as will be described later, in a region where y is excessively high, from the viewpoint of atomic bonding with elements other than Si in base metal, there may be a factor that reduces the adhesion of the tension coating. Furthermore, in a region where x is very low (the amount of oxide itself is very small), it is also difficult to detect a very high y value by infrared reflection spectroscopy with a general measurement sensitivity. Considering these, it is considered preferable to make a limitation such that the upper left region of FIG. 1 is excluded.

Therefore, in the present embodiment, x and y satisfy the relationship of, preferably $$6440x^{2.5} \geq y$$

and more preferably, $$4037x^{2.5} \geq y. \quad (4),$$

In practice, in a case where an externally oxidized $SiO_2$ film was formed on a normal final-annealed steel sheet in a thermal oxidation annealing atmosphere (refer to Patent Document 3) with 75 vol % of hydrogen, 25 vol % of nitrogen, a dew point of 0° C., and an oxidation potential of $P_{H2O}/P_{H2}$ of about 0.008, good coating adhesion could not be obtained. However, it was found that good coating adhesion can be obtained by controlling both the amount of surface oxygen of the final-annealed steel sheet before thermal oxidation annealing and the oxidation potential of the thermal oxidation annealing atmosphere within a predetermined range. Specifically, it is necessary to set the oxidation potential to 0.0081 or less in a case where the amount of surface oxygen of the final-annealed steel sheet is more than 0.01 g/m$^2$ and 0.05 g/m$^2$ or less, and to 0.005 or less (less than 0.0055) in a case where the amount of surface oxygen of the final-annealed steel sheet is more than 0.05 g/m$^2$ and 0.10 g/m$^2$ or less.

The necessity of controlling the oxidation potential $P_{H2O}/P_{H2}$ of the thermal oxidation annealing atmosphere as described above is considered as follows.

In a case where the oxidation potential $P_{H2O}/P_{H2}$ of the thermal oxidation annealing atmosphere is excessive, although the externally oxidized $SiO_2$ is generated on the surface of the final-annealed steel sheet, on the one hand, Fe-based oxides are not generated, and there are cases where Mn and Cr form oxides in combination with $SiO_2$. As described above, in a case where the $SiO_2$ film thickness of the base sheet is small in a situation in which trace elements are oxidized, internal oxidation occurs during the baking and formation of the tension coating, and the coating adhesion is reduced.

Therefore, during the thermal oxidation annealing, the oxidation potential $P_{H2O}/P_{H2}$ of the thermal oxidation annealing atmosphere needs to be 0.0081 or less, or 0.005 or less to prevent the generation of oxides other than $SiO_2$ as much as possible.

The upper limit of an allowable oxidation potential is determined according to the amount of surface oxygen of the final-annealed steel sheet before thermal oxidation annealing.

Usually, prior to thermal oxidation annealing, the final-annealed steel sheet is pickled or washed with water in order to remove the annealing separator such as alumina used in the final annealing. On the other hand, in the method of manufacturing the base sheet according to the present embodiment, as the surface properties of the final-annealed steel sheet that is subjected to the thermal oxidation after the pickling or washing with water, the amount of oxygen per one surface of the base sheet is more than 0.010 g/m$^2$, preferably 0.015 g/m$^2$ or more, even more preferably 0.020 g/m$^2$ or more, and more preferably 0.025 g/m$^2$ or more, and the upper limit thereof is 0.100 g/m$^2$ or less, preferably 0.060 g/m$^2$ or less, and even more preferably 0.050 g/m$^2$ or less. In a case where the amount of surface oxygen per one surface of the final-annealed steel sheet is set to more than 0.01 g/m$^2$ and 0.05 g/m$^2$ or less, the oxidation potential $P_{H2O}/P_{H2}$ in the subsequent thermal oxidation annealing may be 0.0081 or less. On the other hand, in a case where the amount of surface oxygen per one surface of the final-annealed steel sheet is more than 0.05 g/m$^2$ and 0.10 g/m$^2$ or less, the oxidation potential $P_{H2O}/P_{H2}$ in the subsequent thermal oxidation annealing may be 0.005 or less.

A method of controlling the amount of surface oxygen of the final-annealed steel sheet is not limited. Those skilled in the art can easily control the amount of oxygen within the above range by controlling the amount of oxides or hydroxides on the surface of the steel sheet. However, it should be noted that the findings of the present inventors that the amount of oxygen of the final-annealed steel sheet before the thermal oxidation annealing has to be controlled to a certain value or more, and its remarkable effect are not known.

An example of the method of controlling the amount of surface oxygen of the final-annealed steel sheet will be described below. Specifically, in the base sheet according to the present embodiment, it is possible to apply means for leaving an appropriate amount of the annealing separator in a process of removing the annealing separator which is an oxide, the process being performed after final annealing. Alternatively, the surface may be oxidized by completely removing the oxide containing the annealing separator, mirror-finishing the surface, and then performing a heat treatment in an appropriate atmosphere.

In a case where the oxide is present on the surface of the final-annealed steel sheet and the oxidation potential $P_{H2O}/P_{H2}$ of the thermal oxidation annealing atmosphere is low, an externally oxidized $SiO_2$ layer is formed while reducing oxides (iron oxides and the like) other than $SiO_2$ present on the surface of the final-annealed steel sheet. Therefore, it is considered that the formation of the formation of the externally oxidized $SiO_2$ film proceeds slowly and the externally oxidized $SiO_2$ film of the base sheet becomes dense.

Similar to the amount of oxygen per one surface of the base sheet after the thermal oxidation described above, the amount of oxygen per one surface of the final-annealed steel sheet is obtained by analyzing the amount of oxygen at five points on the surface of the final-annealed steel sheet with EMGA-920 manufactured by HORIBA, calculating the amount of oxygen per one surface of the final-annealed steel sheet at the measurement points from the analysis values using the sheet thickness of the test material and the specific gravity of an Fe—Si alloy described in JIS corresponding to the amount of Si, and averaging these values.

In the method of manufacturing the base sheet according to the present embodiment, the externally oxidized film formed by the thermal oxidation annealing is an oxide film containing 50 mass % or more of $SiO_2$. When the amount of $SiO_2$ is 50 mass % or more, the film structure becomes dense, internal oxidation that occurs during the heat treatment for forming the tension coating is suppressed, and the coating adhesion of the tension coating is improved.

As the amount of $SiO_2$ in the externally oxidized film increases, the effect of suppressing internal oxidation during the heat treatment for forming the tension coating increases. Therefore, the upper limit of the amount of $SiO_2$ is not particularly limited. Therefore, the externally oxidized film may be a $SiO_2$ film (a film substantially composed of only $SiO_2$). However, in practice, the upper limit of the amount of $SiO_2$ in the externally oxidized film is about 99%.

However, when the externally oxidized film of the base sheet becomes an almost pure $SiO_2$ film, it is considered that the atomic bond between Fe or the like of the steel sheet and the externally oxidized film disappears from the viewpoint of atomic bond with an element other than Si in the base metal, resulting a reduction in the adhesion of the tension coating. That is, it is considered that it is preferable that not all of O in the externally oxidized film is completely bonded to Si, but a portion of O is bonded to Fe diffused from the steel sheet, especially on the side on which the film is in contact with the steel sheet.

In the base sheet according to the present embodiment, it is preferable that a requirement of $$y \leq 0.89 \quad (3)$$

is satisfied. In a case where Formula (3) is satisfied, the above situation is achieved, which is more preferable. y is more preferably 0.74 or less, and even more preferably 0.66 or less.

The externally oxidized film of the base sheet formed by the method of manufacturing the base sheet according to the present embodiment preferably has a film thickness of 2 nm or more and less than 40 nm. In a case where the film thickness is 40 nm or more, there is no problem from the viewpoint of the adhesion of the tension coating. However, since high-temperature annealing is required in the thermal oxidation annealing to achieve such a film thickness, there is concern that strain may be introduced and the iron loss characteristics of the grain-oriented electrical steel sheet may be impaired. Therefore, the film thickness of the externally oxidized film is preferably less than 40 nm.

On the other hand, when the film thickness of the externally oxidized film of the base sheet is less than 2 nm, it becomes difficult to suppress internal oxidation during the heat treatment for forming the tension coating. The externally oxidized layer formed by the method of manufacturing the base sheet according to the present embodiment preferably has a film thickness of 2 nm or more. However, when the amount of oxygen x and y ($\Delta R/R_0$) indicating the amount of $SiO_2$ present in the vicinity of the outermost surface satisfy Formula (1) described above, and y further satisfies Formula (2) described later, the amount of $SiO_2$ required to cause the film thickness to be 2 nm or more is secured. In practice, as confirmed by the present inventors, the film thickness of the externally oxidized film satisfying Formula (1) and Formula (2) was 2 nm or more. Therefore, it is considered that it is not necessary to particularly limit the film thickness of the externally oxidized film.

The film thickness of the externally oxidized film is measured by creating a sliced section sample including a base iron-$SiO_2$ interface by a focused ion beam method (FIB method) and observing the sample with a transmission electron microscope (TEM). The above-mentioned measurement is performed at five points, and the average thereof is regarded as the film thickness of the externally oxidized film of the base sheet.

In the base sheet according to the present embodiment, the lower limit of y is defined in consideration of the bonding state of O in the $SiO_2$ film as well as the film thickness. This is because the $SiO_2$ film is not present on the surface of the base sheet in which the peak of $SiO_2$ is not detected, and the above-mentioned effect is not exhibited.

In the base sheet according to the present embodiment, the lower limit of y is defined by Formula (2).

$$y \geq 0.24 \quad (2)$$

y is preferably 0.25 or more, and more preferably 0.27.

The base sheet according to the present embodiment is manufactured by performing thermal oxidation annealing on the final-annealed steel sheet in which the amount of surface oxygen is adjusted, at a soaking temperature 1000° C. or lower in an atmosphere in which the oxidation potential represented by a ratio $P_{H2O}/P_{H2}$ of water vapor pressure to hydrogen pressure is within a predetermined range to form externally oxidized layer primarily containing $SiO_2$ on the surface of the final-annealed steel sheet.

When the soaking temperature in the thermal oxidation annealing exceeds 1000° C., not only the final-annealed steel sheet softens and the passability deteriorates, but also does the film thickness of the externally oxidized film become excessive, so that the sheet threading speed locally fluctuates, strain is introduced into the final-annealed steel sheet, and the iron loss characteristics of the grain-oriented electrical steel sheet deteriorate. Therefore, the soaking temperature in the thermal oxidation annealing is set to 1000° C. or lower. The soaking temperature in the thermal oxidation annealing is preferably 950° C. or lower.

The soaking temperature in the thermal oxidation annealing may be a temperature at which an externally oxidized film satisfying the above requirements can be formed, and the lower limit thereof is not particularly limited. However, when the soaking temperature in the thermal oxidation annealing is lower than 600° C., it is difficult to form an externally oxidized film having a sufficient thickness within a practical annealing time. Therefore, the soaking temperature is preferably 600° C. or higher.

As described above, in a case where the amount of surface oxygen per one surface of final-annealed steel sheet is set to more than 0.01 g/m$^2$ and 0.05 g/m$^2$ or less, the oxidation potential $P_{H2O}/P_{H2}$ in the subsequent thermal oxidation annealing may be 0.0081 or less. The oxidation potential $P_{H2O}/P_{H2}$ of the thermal oxidation annealing atmosphere is preferably 0.005 or less or 0.004 or less. On the other hand, in a case where the amount of surface oxygen per one surface of the final-annealed steel sheet is more than 0.05 g/m$^2$ and 0.10 g/m$^2$ or less, the oxidation potential $P_{H2O}/P_{H2}$ in the subsequent thermal oxidation annealing may be 0.005 or less. The oxidation potential $P_{H2O}/P_{H2}$ in the subsequent thermal oxidation annealing is preferably 0.004 or less.

When the oxidation potential $P_{H2O}/P_{H2}$ of the thermal oxidation annealing atmosphere is excessive, while the film thickness of the externally oxidized $SiO_2$ film is increased, Mn, Cr, and the like are also oxidized. These oxides serve as the origin of internal oxidation that occurs during the heat treatment for forming the tension coating, and there is concern that the coating adhesion may be impaired. Therefore, the oxidation potential $P_{H2O}/P_{H2}$ of the thermal oxidation annealing atmosphere is set to the above value or less.

The oxidation potential $P_{H2O}/P_{H2}$ of the thermal oxidation annealing atmosphere may be appropriately set within the above range, and the lower limit thereof is not particularly limited. However, it is difficult to industrially realize an oxidation potential $P_{H2O}/P_{H2}$ of less than 0.00001. Furthermore, in a case where an oxidation potential of less than 0.00001 $P_{H2O}/P_{H2}$ is applied, it is difficult to form an externally oxidized film having a sufficient thickness within a practical annealing time in a temperature range in which sheet passing is stable. Therefore, the substantial lower limit of the oxidation potential $P_{H2O}/P_{H2}$ of the thermal oxidation annealing atmosphere is 0.00001. The oxidation potential $P_{H2O}/P_{H2}$ of the thermal oxidation annealing atmosphere is preferably 0.00010 or more.

In the method of manufacturing a grain-oriented electrical steel sheet according to the present embodiment, a tension coating-forming coating agent is applied to the base sheet according to the present embodiment, a tension coating forming heat treatment is performed in a baking atmosphere in which an oxidation potential represented by a ratio $P_{H2O}/P_{H2}$ of water vapor pressure to hydrogen pressure is 0.001 to 0.20.

A tension coating is formed on the surface of the base sheet on which the externally oxidized film is formed by the thermal oxidation annealing. In the method of manufacturing a grain-oriented electrical steel sheets according to the present embodiment, the tension coating-forming coating agent, for example, a coating agent containing colloidal silica and phosphate is applied to the surface of the externally oxidized film of the base sheet according to the present embodiment, and the tension coating forming heat treatment is performed at a predetermined heat treatment temperature, for example, 750° C. to 920° C. By this tension coating forming heat treatment, a grain-oriented electrical steel sheet having a steel sheet and a tension coating disposed on the surface thereof can be finally obtained.

The tension coating forming heat treatment is performed in an atmosphere in which the ratio $P_{H2O}/P_{H2}$ of water vapor pressure to hydrogen pressure (oxidation potential) is 0.001 to 0.20. By forming the tension coating in this atmosphere, the predetermined externally oxidized $SiO_2$ film formed by the manufacturing method according to the present embodiment suppresses slight internal oxidation that occurs at an initial stage of film formation, so that sufficient and stable adhesion of the tension coating can be secured.

When the oxidation potential in the tension coating forming heat treatment exceeds 0.20, internal oxidation caused by of $H_2O$ in the atmosphere occurs. Therefore, $P_{H2O}/P_{H2}$ (oxidation potential) in the tension coating forming heat treatment is set to 0.20 or less. In the tension coating forming heat treatment, $P_{H2O}/P_{H2}$ is preferably 0.10 or less. On the other hand, when $P_{H2O}/P_{H2}$ (oxidation potential) in the tension coating forming heat treatment is less than 0.001, phosphate decomposes during the heat treatment, $H_2O$ is generated, and internal oxidation occurs. Therefore, $P_{H2O}/P_{H2}$ in the tension coating forming heat treatment is set to 0.001 or more. In the tension coating forming heat treatment, $P_{H2O}/P_{H2}$ in is preferably 0.003 or more.

The heat treatment temperature in the tension coating forming heat treatment is preferably 750° C. to 920° C. When the heat treatment temperature in the tension coating forming heat treatment is lower than 750° C., there are cases where the required coating adhesion is not obtained. Therefore, the heat treatment temperature is preferably 750° C. or higher. On the other hand, when the heat treatment temperature in the tension coating forming heat treatment exceeds 920° C., there are cases where the required coating adhesion is not obtained. Therefore, the heat treatment temperature is preferably 920° C. or lower.

EXAMPLES

Hereinafter, examples of the present invention will be described. Conditions adopted in the examples are examples for confirming the feasibility and effect of the present invention, and the present invention is not limited thereto. Various conditions can be adopted as long as the object of the present invention is achieved without departing from the present invention.

Example 1

A cold-rolled steel sheet for manufacturing a grain-oriented electrical steel sheet having a sheet thickness of 0.225 mm and containing 3.3 mass % of Si is subjected to decarburization annealing, and a water slurry of an annealing separator primarily alumina is applied to the surface of the decarburization-annealed steel sheet and dried, and the resultant is coiled into a coil shape. Next, the decarburization-annealed steel sheet is subjected to secondary recrystallization in a dry nitrogen atmosphere, and is subjected to purification annealing (final annealing) at 1200° C. in a dry hydrogen atmosphere to obtain a final-annealed grain-oriented silicon steel sheet. This final-annealed steel sheet does not contain MgO in the annealing separator and thus does not have a glass film on its surface.

A pickling time of this final-annealed steel sheet is adjusted with 0.3% sulfuric acid solution such that the amount of oxygen per one surface is controlled to 0.01 g/m$^2$, 0.04 g/m$^2$, or 0.06 g/m$^2$. Then, in each of the final-annealed steel sheets is subjected to thermal oxidation annealing in an atmosphere with 25 vol % of nitrogen and 75 vol % of hydrogen and $P_{H2O}/P_{H2}$ (oxidation potential) and a dew point described in the tables, at a soaking temperature (thermal oxidation temperature) described in the tables for a soaking time of 30 seconds. A steel sheet having an amount of oxygen of 0.01 g/m$^2$ per one surface is in a state called "mirror-finished state" or "absence of inorganic mineral substances" in the related art.

The amount of oxygen per one surface of the base sheet for a grain-oriented electrical steel sheet (base sheet) after thermal oxidation annealing is analyzed, and the infrared absorption spectrum of the surface of this base sheet is measured. In addition, a mixed solution (coating agent) containing 50 ml of a 50 mass % aluminum phosphate aqueous solution, 100 ml of a 20 mass % colloidal silica aqueous dispersion liquid, and 5 g of chromic anhydride is applied to the surface of the base sheet, and the resultant is subjected to baking annealing (tension coating forming heat treatment) at 830° C. for 30 seconds.

An annealing atmosphere during this baking annealing (tension coating forming heat treatment) is set to an atmosphere with 25 vol % of nitrogen, 75 vol % of hydrogen, and a dew point of +5° C. (oxidation potential $P_{H2O}/P_{H2}$: 0.012).

After forming a tension coating, the coating adhesion is evaluated by the area fraction of remained coating when the sample is wound around a cylinder having a diameter of 20 mm and then unwound. The adhesion of the tension coating having a fraction of remained coating of 95% or more is determined to be good (G), the adhesion of the tension coating having a fraction of remained coating of 90% or more and less than 95% is determined to be bad (B), and the adhesion of the tension coating having a fraction of remained coating of less than 90% or more is determined to be very bad (VB). The base sheet whose adhesion is determined to be "G" is determined to be a base sheet capable of stably securing the adhesion of the tension coating. The results are shown in Table 1. In the examples of the invention, it can be seen that the coating adhesion is excellent.

TABLE 1

| Test No. | Amount of surface oxygen (g/m$^2$) | Thermal oxidation temperature (° C.) | Thermal oxidation due point (° C.) | $P_{H2O}/P_{H2}$ | $\Delta R/R_0$ | Amount of oxygen per one surface (g/m$^2$) | Film thickness of $SiO_2$ (nm) | Fraction of remained coating after 20φ bending (%) Fraction | Evaluation | Value of $1500x^{2.5}$ | Remarks |
|---|---|---|---|---|---|---|---|---|---|---|---|
| 1-1 | 0.04 | 850 | −30 | 0.0005 | 0.24 | 0.0275 | 10 | 97 | G | 0.19 | Inventive Example |
| 1-2 | 0.04 | 850 | −10 | 0.0034 | 0.27 | 0.0241 | 12 | 100 | G | 0.14 | Inventive Example |
| 1-3 | 0.04 | 850 | 0 | 0.0081 | 0.31 | 0.0280 | 14 | 95 | G | 0.20 | Inventive Example |
| 1-4 | 0.04 | 850 | 10 | 0.0164 | 0.44 | 0.0389 | 19 | 90 | B | 0.45 | Comparative Example |
| 1-5 | 0.04 | 850 | 30 | 0.0583 | 0.40 | 0.0689 | 34 | 30 | VB | 1.87 | Comparative Example |
| 1-6 | 0.06 | 850 | −30 | 0.0005 | 0.44 | 0.0260 | 8 | 100 | G | 0.16 | Inventive Example |
| 1-7 | 0.06 | 850 | −10 | 0.0034 | 0.66 | 0.0324 | 14 | 99 | G | 0.28 | Inventive Example |
| 1-8 | 0.06 | 850 | 0 | 0.0081 | 0.87 | 0.0527 | 23 | 92 | B | 0.96 | Comparative Example |
| 1-9 | 0.06 | 850 | 10 | 0.0164 | 0.49 | 0.0423 | 16 | 80 | VB | 0.55 | Comparative Example |

TABLE 1-continued

| Test No. | Amount of surface oxygen ($g/m^2$) | Thermal oxidation temperature (° C.) | Thermal oxidation due point (° C.) | $P_{H2O}/P_{H2}$ | $\Delta R/R_0$ | Amount of oxygen per one surface ($g/m^2$) | Film thickness of $SiO_2$ (nm) | Fraction of remained coating after 20φ bending (%) Fraction | Evaluation | Value of $1500x^{2.5}$ | Remarks |
|---|---|---|---|---|---|---|---|---|---|---|---|
| 1-10 | 0.06 | 850 | 30 | 0.0583 | 0.35 | 0.0655 | 30 | 40 | VB | 1.65 | Comparative Example |
| 1-11 | 0.04 | 950 | −30 | 0.0005 | 0.52 | 0.0333 | 15 | 99 | G | 0.30 | Inventive Example |
| 1-12 | 0.04 | 950 | −10 | 0.0034 | 0.60 | 0.0344 | 17 | 100 | G | 0.33 | Inventive Example |
| 1-13 | 0.04 | 950 | 0 | 0.0081 | 0.69 | 0.0385 | 20 | 99 | G | 0.44 | Inventive Example |
| 1-14 | 0.04 | 950 | 10 | 0.0164 | 0.98 | 0.0535 | 27 | 92 | B | 1.00 | Comparative Example |
| 1-15 | 0.04 | 950 | 30 | 0.0583 | 0.77 | 0.1566 | 69 | 30 | VB | 14.56 | Comparative Example |
| 1-16 | 0.06 | 950 | −30 | 0.0005 | 0.74 | 0.0387 | 15 | 100 | G | 0.44 | Inventive Example |
| 1-17 | 0.06 | 950 | −10 | 0.0034 | 0.89 | 0.0401 | 20 | 100 | G | 0.48 | Inventive Example |
| 1-18 | 0.06 | 950 | 0 | 0.0081 | 0.98 | 0.0740 | 31 | 90 | B | 2.24 | Comparative Example |
| 1-19 | 0.06 | 950 | 10 | 0.0164 | 0.82 | 0.0775 | 60 | 80 | VB | 2.50 | Comparative Example |
| 1-20 | 0.06 | 950 | 30 | 0.0583 | 0.57 | 0.3546 | 162 | 40 | VB | 112.30 | Comparative Example |
| 1-21 | 0.01 | 850 | −30 | 0.0005 | 0.12 | 0.0152 | 7 | 40 | VB | 0.04 | Comparative Example |
| 1-22 | 0.01 | 850 | −10 | 0.0034 | 0.15 | 0.0172 | 9 | 75 | VB | 0.06 | Comparative Example |
| 1-23 | 0.01 | 850 | 0 | 0.0081 | 0.22 | 0.0253 | 13 | 80 | VB | 0.15 | Comparative Example |
| 1-24 | 0.01 | 850 | 10 | 0.0164 | 0.82 | 0.0620 | 27 | 75 | VB | 1.44 | Comparative Example |
| 1-25 | 0.01 | 850 | 30 | 0.0583 | 0.97 | 0.1373 | 61 | 51 | VB | 10.48 | Comparative Example |
| 1-26 | 0.01 | 950 | −30 | 0.0005 | 0.17 | 0.0192 | 10 | 80 | VB | 0.08 | Comparative Example |
| 1-27 | 0.01 | 950 | −10 | 0.0034 | 0.21 | 0.0211 | 12 | 30 | VB | 0.10 | Comparative Example |
| 1-28 | 0.01 | 950 | 0 | 0.0081 | 0.40 | 0.0384 | 28 | 81 | VB | 0.43 | Comparative Example |
| 1-29 | 0.01 | 950 | 10 | 0.0164 | 0.90 | 0.0920 | 41 | 38 | VB | 3.85 | Comparative Example |
| 1-30 | 0.01 | 950 | 30 | 0.0583 | 0.85 | 0.1724 | 75 | 70 | VB | 18.51 | Comparative Example |
| 1-31 | 0.01 | 800 | −15 | 0.0022 | 0.18 | 0.0090 | 5 | 69 | VB | 0.01 | Comparative Example |
| 1-32 | 0.01 | 900 | −5 | 0.0053 | 0.20 | 0.0209 | 10 | 50 | VB | 0.09 | Comparative Example |
| 1-33 | 0.01 | 1150 | −20 | 0.0014 | 0.98 | 0.0623 | 45 | 35 | VB | 1.45 | Comparative Example |
| 1-34 | 0.01 | 750 | 13 | 0.0200 | 0.80 | 0.0740 | 36 | 36 | VB | 2.23 | Comparative Example |
| 1-35 | 0.01 | 650 | 58 | 0.3000 | 0.15 | 0.0050 | 2 | 56 | VB | 0.00 | Comparative Example |
| 1-36 | 0.01 | 800 | 40 | 0.1000 | 0.25 | 0.0630 | 30 | 75 | VB | 1.49 | Comparative Example |

Example 2

To a steel sheet after thermal oxidation annealing, which was produced in the same manner as in Test No. 1-2 of Table 1, a mixed solution containing 50 liters of a 50 mass % aluminum phosphate/magnesium aqueous solution, 100 liters of a 20 mass % colloidal silica aqueous dispersion liquid, and 5 kg of chromic anhydride is applied, and the resultant was subjected to baking annealing at 850° C. for 20 seconds. An atmosphere during the baking annealing was set to an atmosphere with 25 vol % of nitrogen, 75 vol % of hydrogen, and a dew point of −30° C. to +60° C.

After forming a tension coating on the steel sheet, the test piece collected from the steel sheet was wound around a cylinder having a diameter of 20 mm, and then the coating adhesion was evaluated by the area fraction of remained coating when unwound. The results are shown in Table 2. The evaluation criteria for the adhesion of the coating are the same as in Example 1. In Example 2, the condition of the tension coating forming heat treatment under which the adhesion is determined to be "G" is determined as a method of manufacturing a grain-oriented electrical steel sheet capable of stably securing the adhesion of the tension coating. In the examples of the invention, it can be seen that the coating adhesion is excellent.

TABLE 2

| Test No. | Amount of oxygen in base sheet ($g/m^2$) | Thermal oxidation conditions: Thermal oxidation temperature (° C.) | Thermal oxidation due point (° C.) | Thermal oxidation $P_{H2O}/P_{H2}$ | Oxidized layer: $\Delta R/R_0$ | Amount of oxygen per one surface ($g/m^2$) | Film thickness of $SiO_2$ (nm) | Baking conditions: Baking atmosphere | Baking due point (° C.) | Baking $P_{H2O}/P_{H2}$ | Baking temperature (° C.) | Baking time (second) | Evaluation of coating adhesion: Fraction of remained coating after 20φ bending (%) | Evaluation | Value of $1500x^{2.5}$ | Remarks |
|---|---|---|---|---|---|---|---|---|---|---|---|---|---|---|---|---|
| 2-1 | 0.04 | 850 | 0 | 0.0081 | 0.31 | 0.0280 | 14 | 25%$N_2$ + 75%$H_2$ | −30 | 0.0005 | 850 | 20 | 90 | B | 0.14 | Comparative Example |

TABLE 2-continued

| Test No. | Amount of oxygen in base sheet (g/m²) | Thermal oxidation conditions: Thermal oxidation temperature (° C.) | Thermal oxidation due point (° C.) | Thermal oxidation $P_{H2O}/P_{H2}$ | Oxidized layer: $\Delta R/R_0$ | Amount of oxygen per one surface (g/m²) | Film thickness of $SiO_2$ (nm) | Baking conditions: Baking atmosphere | Baking due point (° C.) | Baking $P_{H2O}/P_{H2}$ | Baking temperature (° C.) | Baking time (second) | Evaluation of coating adhesion: Fraction of remained coating after 20φ bending (%) | Evaluation | Value of $1500x^{2.5}$ | Remarks |
|---|---|---|---|---|---|---|---|---|---|---|---|---|---|---|---|---|
| 2-2 | 0.04 | 850 | 0 | 0.0081 | 0.31 | 0.0280 | 14 | 25%$N_2$ + 75%$H_2$ | −20 | 0.0014 | 850 | 20 | 95 | G | 0.14 | Inventive Example |
| 2-3 | 0.04 | 850 | 0 | 0.0081 | 0.31 | 0.0280 | 14 | 25%$N_2$ + 75%H2 | −15 | 0.002 | 850 | 20 | 97 | G | 0.14 | Inventive Example |
| 2-4 | 0.04 | 850 | 0 | 0.0081 | 0.31 | 0.0280 | 14 | 25%$N_2$ + 75%$H_2$ | 0 | 0.008 | 850 | 20 | 99 | G | 0.14 | Inventive Example |
| 2-5 | 0.04 | 850 | 0 | 0.0081 | 0.31 | 0.0280 | 14 | 25%$N_2$ + 75%$H_2$ | 5 | 0.012 | 850 | 20 | 100 | G | 0.14 | Inventive Example |
| 2-6 | 0.04 | 850 | 0 | 0.0081 | 0.31 | 0.0280 | 14 | 25%$N_2$ + 75%$H_2$ | 20 | 0.030 | 850 | 20 | 100 | G | 0.14 | Inventive Example |
| 2-7 | 0.04 | 850 | 0 | 0.0081 | 0.31 | 0.0280 | 14 | 25%$N_2$ + 75%$H_2$ | 30 | 0.058 | 850 | 20 | 98 | G | 0.14 | Inventive Example |
| 2-8 | 0.04 | 850 | 0 | 0.0081 | 0.31 | 0.0280 | 14 | 25%$N_2$ + 75%$H_2$ | 40 | 0.10 | 850 | 20 | 98 | G | 0.14 | Inventive Example |
| 2-9 | 0.04 | 850 | 0 | 0.0081 | 0.31 | 0.0280 | 14 | 25%$N_2$ + 75%$H_2$ | 50 | 0.19 | 850 | 20 | 95 | G | 0.14 | Inventive Example |
| 2-10 | 0.04 | 850 | 0 | 0.0081 | 0.31 | 0.0280 | 14 | 25%$N_2$ + 75%$H_2$ | 60 | 0.33 | 850 | 20 | 90 | B | 0.14 | Comparative Example |

Example 3

The final-annealed steel sheet produced in the same manner as in Example 1 is pickled, chemically polished, and then subjected to a heat treatment in a nitrogen atmosphere at 300° C. to 500° C. to oxidize the surface of the steel sheet, thereby adjusting the amount of oxygen. These are thermally oxidized with a predetermined oxidation potential, and further subjected to baking annealing and evaluation of the coating adhesion under the same conditions as in Example 1. The evaluation criteria for the adhesion of the coating are the same as in Example 1. The base sheet whose adhesion is determined to be "G" is determined to be a base sheet capable of stably securing the adhesion of the tension coating. The results are shown in Table 3. In the examples of the invention, it can be seen that the coating adhesion is excellent.

TABLE 3

| Test No. | Amount of surface oxygen (g/m²) | Thermal oxidation temperature (° C.) | Thermal oxidation due point (° C.) | $P_{H2O}/P_{H2}$ | $\Delta R/R_0$ | Amount of oxygen per one surface (g/m²) | Film thickness of $SiO_2$ (nm) | Fraction of remained coating after 20φ bending (%): Fraction | Evaluation | Value of $1500x^{2.5}$ | Remarks |
|---|---|---|---|---|---|---|---|---|---|---|---|
| 3-1 | 0.01 | 900 | −30 | 0.0005 | 0.14 | 0.0168 | 8 | 75 | VB | 0.05 | Comparative example |
| 3-2 | 0.02 | 900 | −30 | 0.0005 | 0.24 | 0.0237 | 12 | 100 | G | 0.13 | Inventive example |
| 3-3 | 0.04 | 900 | −30 | 0.0005 | 0.32 | 0.0232 | 13 | 100 | G | 0.12 | Inventive example |
| 3-4 | 0.06 | 900 | −30 | 0.0005 | 0.52 | 0.0227 | 11 | 99 | G | 0.12 | Inventive example |
| 3-5 | 0.09 | 900 | −30 | 0.0005 | 0.32 | 0.0218 | 12 | 97 | G | 0.11 | Inventive example |
| 3-6 | 0.11 | 900 | −30 | 0.0005 | 0.21 | 0.0205 | 10 | 90 | B | 0.09 | Comparative example |
| 3-7 | 0.01 | 900 | 0 | 0.0081 | 0.23 | 0.0238 | 11 | 80 | VB | 0.13 | Comparative example |
| 3-8 | 0.02 | 900 | 0 | 0.0081 | 0.38 | 0.0287 | 15 | 100 | G | 0.21 | Inventive example |
| 3-9 | 0.04 | 900 | 0 | 0.0081 | 0.46 | 0.0328 | 16 | 98 | G | 0.29 | Inventive example |
| 3-10 | 0.06 | 900 | 0 | 0.0081 | 0.91 | 0.0631 | 27 | 93 | B | 1.50 | Comparative example |
| 3-11 | 0.09 | 900 | 0 | 0.0081 | 0.87 | 0.0856 | 35 | 92 | B | 3.22 | Comparative example |
| 3-12 | 0.11 | 900 | 0 | 0.0081 | 0.76 | 0.0929 | 43 | 75 | VB | 3.95 | Comparative example |
| 3-13 | 0.01 | 900 | 10 | 0.0164 | 0.52 | 0.0718 | 35 | 70 | VB | 2.07 | Comparative example |
| 3-14 | 0.02 | 900 | 10 | 0.0164 | 0.63 | 0.0529 | 31 | 80 | VB | 0.97 | Comparative example |
| 3-15 | 0.04 | 900 | 10 | 0.0164 | 0.54 | 0.0430 | 27 | 85 | B | 0.58 | Comparative example |

TABLE 3-continued

| Test No. | Amount of surface oxygen ($g/m^2$) | Thermal oxidation temperature (° C.) | Thermal oxidation due point (° C.) | $P_{H2O}/P_{H2}$ | $\Delta R/R_0$ | Amount of oxygen per one surface ($g/m^2$) | Film thickness of $SiO_2$ (nm) | Fraction of remained coating after 20φ bending (%) Fraction | Evaluation | Value of $1500x^{2.5}$ | Remarks |
|---|---|---|---|---|---|---|---|---|---|---|---|
| 3-16 | 0.06 | 900 | 10 | 0.0164 | 0.50 | 0.0682 | 34 | 30 | VB | 1.82 | Comparative example |
| 3-17 | 0.09 | 900 | 10 | 0.0164 | 0.42 | 0.0826 | 42 | 20 | VB | 2.94 | Comparative example |
| 3-18 | 0.11 | 900 | 10 | 0.0164 | 0.38 | 0.0879 | 39 | 5 | VB | 3.44 | Comparative example |

INDUSTRIAL APPLICABILITY

As described above, according to the present invention, the adhesion of a tension coating can be stably secured even at a thermal oxidation annealing temperature at which strain is not introduced. Specifically, according to the present invention, by controlling the surface properties of a final-annealed steel sheet before thermal oxidation annealing and controlling the atmosphere during the thermal oxidation annealing, at a soaking temperature of 1000° C. or lower, on the surface of a base sheet for a grain-oriented electrical steel sheet, an externally oxidized layer primarily containing $SiO_2$, which can avoid the introduction of strain into the base sheet and can secure sufficient adhesion of the tension coating, can be formed. As a result, according to the present invention, a grain-oriented electrical steel sheet having good adhesion of an insulation coating can be industrially manufactured by an ordinary annealing line. Therefore, the present invention has great applicability to the electrical steel sheet manufacturing industry and the electrical steel sheet utilization industry.

What is claimed is:

1. A base sheet for a grain-oriented electrical steel sheet, wherein an amount of surface oxygen x per one surface of the base sheet and a value y of a peak $\Delta R/R_0$@1250 $cm^{-1}$ of $SiO_2$ on the surface of the base sheet obtained by infrared reflection spectroscopy satisfy $$y \geq 1500x^{25} \ldots \quad (1), \text{ and}$$

$$y \geq 0.24 \ldots \quad (2).$$

2. The base sheet for a grain-oriented electrical steel sheet according to claim 1, further satisfying $$y \leq 0.89 \ldots \quad (3).$$

3. The base sheet for a grain-oriented electrical steel sheet according to claim 1, further satisfying $$6440x^{2.5} \geq y \ldots \quad (4).$$

4. A grain-oriented silicon steel sheet which is used as a material of the base sheet for a grain-oriented electrical steel sheet according to claim 1, wherein an amount of surface oxygen per one surface is more than 0.01 $g/m^2$ and 0.1 $g/m^2$ or less.

5. A method of manufacturing the base sheet for a grain-oriented electrical steel sheet according to claim 1, the method comprising:

adjusting an amount of surface oxygen per one surface of a final-annealed grain-oriented silicon steel sheet to more than 0.01 $g/m^2$ and 0.05 $g/m^2$ or less, or more than 0.05 $g/m^2$ and 0.10 $g/m^2$ or less; and performing thermal oxidation annealing on the final-annealed grain-oriented silicon steel sheet in an atmosphere in which an oxidation potential represented by a ratio $P_{H2O}/P_{H2}$ of water vapor pressure to hydrogen pressure is 0.0081 or less in a case where the amount of surface oxygen is more than 0.01 $g/m^2$ and 0.05 $g/m^2$ or less, or in an atmosphere in which the oxidation potential is 0.005 or less in a case where the amount of surface oxygen is more than 0.05 $g/m^2$ and 0.10 $g/m^2$ or less, at a soaking temperature of 1000° C. or lower to form an externally oxidized layer on a surface of the grain-oriented silicon steel sheet;

thereby producing the base sheet for a grain-oriented electrical steel sheet of claim 1.

6. A method of manufacturing a grain-oriented electrical steel sheet, comprising:

applying a tension coating-forming coating agent to the base sheet for a grain-oriented electrical steel sheet according to claim 1; and performing a tension coating forming heat treatment in a baking atmosphere in which an oxidation potential represented by a ratio $P_{H2O}/P_{H2}$ of water vapor pressure to hydrogen pressure is 0.001 to 0.20.

7. The base sheet for a grain-oriented electrical steel sheet according to claim 2, further satisfying $$6440x^{2.5} \geq y \ldots \quad (4).$$

8. A grain-oriented silicon steel sheet which is used as a material of the base sheet for a grain-oriented electrical steel sheet according to claim 2, wherein an amount of surface oxygen per one surface is more than 0.01 $g/m^2$ and 0.1 $g/m^2$ or less.

9. A grain-oriented silicon steel sheet which is used as a material of the base sheet for a grain-oriented electrical steel sheet according to claim 3, wherein an amount of surface oxygen per one surface is more than 0.01 $g/m^2$ and 0.1 $g/m^2$ or less.

10. A grain-oriented silicon steel sheet which is used as a material of the base sheet for a grain-oriented electrical steel sheet according to claim 7, wherein an amount of surface oxygen per one surface is more than 0.01 $g/m^2$ and 0.1 $g/m^2$ or less.

11. A method of manufacturing the base sheet for a grain-oriented electrical steel sheet according to claim 2, the method comprising:

adjusting an amount of surface oxygen per one surface of a final-annealed grain-oriented silicon steel sheet to more than 0.01 $g/m^2$ and 0.05 $g/m^2$ or less, or more than 0.05 $g/m^2$ and 0.10 $g/m^2$ or less; and performing thermal oxidation annealing on the final-annealed grain-oriented silicon steel sheet in an atmosphere in which an oxidation potential represented by a ratio $P_{H2O}/P_{H2}$ of water vapor pressure to hydrogen pressure is 0.0081 or less in a case where the amount of surface oxygen is more than 0.01 $g/m^2$ and 0.05 $g/m^2$ or less, or in an atmosphere in which the oxidation potential is 0.005 or less in a case where the amount of surface oxygen is more than 0.05 g/m$^2$ and 0.10 g/m$^2$ or less, at a soaking temperature of 1000° C. or lower to form an externally oxidized layer on a surface of the grain-oriented silicon steel sheet;

thereby producing the base sheet for a grain-oriented electrical steel sheet of claim 2.

12. A method of manufacturing the base sheet for a grain-oriented electrical steel sheet according to claim 3, the method comprising:

adjusting an amount of surface oxygen per one surface of a final-annealed grain-oriented silicon steel sheet to more than 0.01 g/m$^2$ and 0.05 g/m$^2$ or less, or more than 0.05 g/m$^2$ and 0.10 g/m$^2$ or less; and performing thermal oxidation annealing on the final-annealed grain-oriented silicon steel sheet in an atmosphere in which an oxidation potential represented by a ratio $P_{H2O}/P_{H2}$ of water vapor pressure to hydrogen pressure is 0.0081 or less in a case where the amount of surface oxygen is more than 0.01 g/m$^2$ and 0.05 g/m$^2$ or less, or in an atmosphere in which the oxidation potential is 0.005 or less in a case where the amount of surface oxygen is more than 0.05 g/m$^2$ and 0.10 g/m$^2$ or less, at a soaking temperature of 1000° C. or lower to form an externally oxidized layer on a surface of the grain-oriented silicon steel sheet;

thereby producing the base sheet for a grain-oriented electrical steel sheet of claim 3.

13. A method of manufacturing the base sheet for a grain-oriented electrical steel sheet according to claim 7, the method comprising:

adjusting an amount of surface oxygen per one surface of a final-annealed grain-oriented silicon steel sheet to more than 0.01 g/m$^2$ and 0.05 g/m$^2$ or less, or more than 0.05 g/m$^2$ and 0.10 g/m$^2$ or less; and performing thermal oxidation annealing on the final-annealed grain-oriented silicon steel sheet in an atmosphere in which an oxidation potential represented by a ratio $P_{H2O}/P_{H2}$ of water vapor pressure to hydrogen pressure is 0.0081 or less in a case where the amount of surface oxygen is more than 0.01 g/m$^2$ and 0.05 g/m$^2$ or less, or in an atmosphere in which the oxidation potential is 0.005 or less in a case where the amount of surface oxygen is more than 0.05 g/m$^2$ and 0.10 g/m$^2$ or less, at a soaking temperature of 1000° C. or lower to form an externally oxidized layer on a surface of the grain-oriented silicon steel sheet;

thereby producing the base sheet for a grain-oriented electrical steel sheet of claim 7.

14. A method of manufacturing a grain-oriented electrical steel sheet, comprising:

applying a tension coating-forming coating agent to the base sheet for a grain-oriented electrical steel sheet according to claim 2; and performing a tension coating forming heat treatment in a baking atmosphere in which an oxidation potential represented by a ratio $P_{H2O}/P_{H2}$ of water vapor pressure to hydrogen pressure is 0.001 to 0.20.

15. A method of manufacturing a grain-oriented electrical steel sheet, comprising:

applying a tension coating-forming coating agent to the base sheet for a grain-oriented electrical steel sheet according to claim 3; and performing a tension coating forming heat treatment in a baking atmosphere in which an oxidation potential represented by a ratio $P_{H2O}/P_{H2}$ of water vapor pressure to hydrogen pressure is 0.001 to 0.20.

16. A method of manufacturing a grain-oriented electrical steel sheet, comprising:

applying a tension coating-forming coating agent to the base sheet for a grain-oriented electrical steel sheet according to claim 7; and performing a tension coating forming heat treatment in a baking atmosphere in which an oxidation potential represented by a ratio $P_{H2O}/P_{H2}$ of water vapor pressure to hydrogen pressure is 0.001 to 0.20.

17. The base sheet for a grain-oriented electrical steel sheet according to claim 1, comprising, by mass %, Si: 0.8% to 7.0%,
C: 0% to 0.085%,
acid-soluble Al: 0% to 0.065%,
N: 0% to 0.012%,
Mn: 0% to 1.0%,
Cr: 0% to 0.3%,
Cu: 0% to 0.4%,
P: 0% to 0.5%,
Sn: 0% to 0.3%,
Sb: 0% to 0.3%,
Ni: 0% to 1.0%,
S: 0% to 0.015%, and
Se: 0% to 0.015%, and
a remainder including Fe and impurities.

18. The grain-oriented silicon steel sheet according to claim 4, comprising, by mass %, Si: 0.8% to 7.0%,
C: 0% to 0.085%,
acid-soluble Al: 0% to 0.065%,
N: 0% to 0.012%,
Mn: 0% to 1.0%,
Cr: 0% to 0.3%,
Cu: 0% to 0.4%,
P: 0% to 0.5%,
Sn: 0% to 0.3%,
Sb: 0% to 0.3%,
Ni: 0% to 1.0%,
S: 0% to 0.015%, and
Se: 0% to 0.015%, and
a remainder including Fe and impurities.

* * * * *